US006731884B2

(12) United States Patent
Kato

(10) Patent No.: US 6,731,884 B2
(45) Date of Patent: May 4, 2004

(54) IMAGE FORMING APPARATUS AND TONER SUPPLY DEVICE AND METHOD USED IN IMAGE FORMING APPARATUS

(75) Inventor: Mitsuhisa Kato, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/213,063

(22) Filed: Aug. 7, 2002

(65) Prior Publication Data

US 2004/0028419 A1 Feb. 12, 2004

(51) Int. Cl.[7] ..... G03G 15/00

(52) U.S. Cl. ..... 399/27; 399/38; 399/49; 399/53

(58) Field of Search ..... 399/27, 29, 30, 399/38, 49, 53, 58, 59, 60, 255, 258, 262, 263

(56) References Cited

U.S. PATENT DOCUMENTS 6,404,997 B1 * 6/2002 Grace ..... 399/27

FOREIGN PATENT DOCUMENTS

JP 5-27528 A 2/1993

JP 2001-34018 A 2/2001

* cited by examiner

*Primary Examiner*—Hoang Ngo

(74) *Attorney, Agent, or Firm*—Foley & Lardner LLP

(57) ABSTRACT

An image forming device is provided including a plurality of developing devices changeable between at least a developing position and a standby position. The image forming device estimates a toner coverage rate for a first developing device at the developing position. If the estimated toner coverage rate is higher than a predetermined value, the first developing device is replenished with toner when a first print is printed before being changed to the standby position. If the estimated toner coverage rate is equal to or less than the predetermined value, the first developing device is replenished with toner before being changed to the developing position for a second print from the standby position.

9 Claims, 5 Drawing Sheets

FIG. 4

RELATIONSHIP BETWEEN TONER DENSITY & IMAGE PROBLEMS

| TONER DENSITY | SENSOR OUTPUT | TONER AMOUNT IN DEVELOPING AGENT | IMAGE PROBLEMS | | |
|---|---|---|---|---|---|
| | | | REDUCED IMAGE DENSITY | ATTACHED CARRIER | SPLASHED TONER |
| 5. 0wt% | 0.90 | 17.5 | × | × | ○ |
| 5. 5wt% | 0.94 | 19.3 | × | × | ○ |
| 6. 0wt% | 0.97 | 21.0 | ○ | × | ○ |
| 6. 5wt% | 1.01 | 22.8 | ○ | ○ | ○ |
| 7. 0wt% ( ) | 1.04 | 24.5 | ○ | ○ | ○ |
| 7. 5wt% | 1.08 | 26.3 | ○ | ○ | ○ |
| 8. 0wt% | 1.11 | 28.0 | ○ | ○ | △ |
| 8. 5wt% | 1.15 | 29.8 | ○ | ○ | × |
| 9. 0wt% | 1.19 | 31.5 | ○ | ○ | × |

TARGET VALUE

○ GOOD
△ FAIR
× POOR

IMAGE FORMING APPARATUS AND TONER SUPPLY DEVICE AND METHOD USED IN IMAGE FORMING APPARATUS

BACKGROUND OF THE INVENTION

1. Field of the Invention

The present invention relates to an image forming apparatus which is usable as a electrophotographic copier or printer and, more specifically, it relates to a toner supply or replenishing device and method in such an image forming apparatus.

2. Description of the Related Art

In an image forming apparatus of two-component developing type which uses a developing agent containing toner and carrier, it is very important to maintain a constant mixture ratio of the toner and the carrier for maintaining the desired level of image quality. In order to maintain the mixture ratio of the toner and the carrier (the mixture ration being referred to as toner density hereinafter) constant, it is necessary to detect the toner density of the developing agent and to supply a toner replenishing device with toner of the same amount as consumed. As a method of detecting the toner density, directly reading the toner density of the developing agent with a magnetic sensor is widely employed.

On the other hand, in an image forming apparatus of two-component developing type wherein a plurality of developing devices is disposed in a rotary revolver unit for successive development of respective colors, such as digital full-color copier, because the developing devices are mounted in the revolver unit which is a rotating body, mounting magnetic sensors to the respective developing devices for detecting the toner density requires a very complicated and costly interface for supplying power to the magnetic sensors and transmitting output information from the magnetic sensors to an electrical device of the apparatus.

In order to solve this problem, Japanese Patent Application KOKAI Publication No. 2001-34018 proposes a method according to which a given toner image is applied or formed on a photosensitive drum or a transfer belt, toner density of the toner image is detected by means of a photo sensor, the toner density of the developing agent is calculated from the density data obtained by the detection, and replenishing of the require amount of toner is performed accordingly. However, this method requires additional processes of toner development to form a latent image on the photosensitive drum and toner image transferring to the transfer belt, so that the toner density detection results are susceptible to external influences such as environment, the photosensitive drum and deterioration of the developing agent, with the result that stabilized detection results cannot be obtained in many cases. For reducing such external influences, it has been necessary to provide a very complicated control to compensate for the toner density on the basis of information from temperature and humidity sensors for the environment, sensor for the photosensitive drum potential and life counter for the developing agent.

According to Japanese Patent Application KOKAI Publication No. Hei 5-27528, there is provided a table showing the relationship between the toner replenishing time and toner replenishing amount for each color toner, the output level of digital image signal of each color is counted for each pixel, the video count number for each color is calculated, predictably determining the toner replenishing time for the image on one original corresponding to the video count number for each color inputted with reference to the above table and toner replenishing is performed accordingly. In this prior art, however, since the toner replenishment is performed on the basis of prediction, there is a fear that an error occurs in the toner replenishing amount due to variation from a set value of toner replenishing mechanism, etc. and, therefore, further additional density control mechanism is required to avoid the error, thus making the apparatus costly and complicated.

It has been proposed by still another method to calculate the density of developing toner by reading directly the reflectivity of light from the developing agent layer on the development sleeve of the developing device by means of a photo sensor with the revolver unit located at the standby position. As compared with the above-described methods, this method does not require additional developing process or transferring process, thus making possible stabilized detection of toner density.

According to this method, however, since the density detection is not performed at the developing position or printing position where the toner is actually consumed and replenished, but at the standby position of the revolver unit, toner replenishment according to the detection result is performed only for the next developing process. For this reason, in printing from an original having a high coverage rate, toner density is reduced below a predetermined range, with the result that problems occur such as reduced image density and attachment of carrier to the photosensitive drum.

SUMMARY OF THE INVENTION

Therefore, it is an object of the present invention to provide a toner replenishing device of an image forming apparatus which is simple in structure, solves the disadvantages inherent in detecting the density of toner on the development sleeve at the standby position of the revolver and makes possible stabilized toner density controlling irrespective of whether the coverage rate of the original rate is low or high, as well as a toner replenishing method and an image forming apparatus using such device and method.

In order to achieve the object, there is provided a toner replenishing device in an image forming apparatus having a plurality of developing devices, wherein the developing devices are changeable between the developing position and standby position and electrostatic latent image on a photosensitive body is developed, which replenishing device comprising a toner density detector for detecting toner density of developing agent layer of the developing device located at the developing position, an original coverage rate calculator for calculating the coverage rate of an original on the basis of data of image printed by the developing device at the developing position, and a control for executing replenishment of a required amount of toner to the developing device at the developing position on the basis of the detected toner density when the developing device is changed from the standby position to the developing position if the coverage rate of the original is a predetermined valve or less than that or less than the predetermined value, and executing replenishment of a required amount of toner to the developing device located at the developing position for printing if the coverage rate of the original is a predetermined valve or higher than that or higher than the predetermined value.

In such a device, calculation of the original coverage rate by the original coverage rate calculator may be performed on the basis of data of image which is being developed by the developing device during the development by the developing device. Furthermore, the original coverage rate calculator is operable to calculate the coverage rate of the original on the basis of data of image printed from the moment of print starting from the top end of the image to be printed until a predetermined printing width of image has been printed, and this predetermined printing width may be changeably set. Additionally, the predetermined value of the coverage rate of the original may be provided as progressive values or continuous values. The toner density detector may be constructed so as to be comprised of a photo sensor for detecting the light reflectivity of the developing agent layer and a toner density calculator for calculating the toner density on the basis of the detected light reflectivity.

An image forming apparatus of the present invention is constructed comprising a plurality of developing devices which are changeable between developing position and standby position, a photosensitive body on which an electrostatic latent image is developed into a toner image by the developing device located at the developing position, an exposure unit for exposing the photosensitive body to light for forming the electrostatic latent image on the photosensitive body, a toner density detector for detecting toner density of developing agent layer of the developing device located at the developing position, an original coverage rate calculator for calculating the coverage rate on the basis of data of image formed by exposure to light on the photosensitive body; and a toner replenisher for replenishing toner to the developing device on the basis of the original coverage rate and the toner density.

In such an image forming apparatus, the original coverage rate calculator is operable to calculate the original coverage rate by adding up the data of image formed by exposure to light on the photosensitive body simultaneously with the development by the developing device at the developing position.

Still furthermore, the present invention provides a toner replenishing method in an image forming apparatus having a plurality of developing devices, wherein the developing devices are changeable between the developing position and standby position and electrostatic latent image on a photosensitive body is developed, comprising the steps of calculating toner density of developing agent layer of the developing device located at the developing position, calculating the coverage rate of an original on the basis of data of image printed by the developing device at the developing position, and replenishing a required amount of toner to the developing device at the developing position on the basis of the calculated toner density when the developing device is changed from the standby position to the developing position if the coverage rate of the original is a predetermined valve or less than that or less than the predetermined value, and replenishing a required amount of toner to the developing device located at the developing position for printing if the coverage rate of the original is a predetermined valve or higher than that or higher than the predetermined value.

In such a toner supply or replenishing method, if the coverage rate of the original is a predetermined valve or higher than that or higher than the predetermined value, toner replenishing to the developing device at the developing position may be initiated before the developing device is changed to the standby position where the toner density detection is performed.

According to the above described structure, the toner density will not be reduced to a range where faulty image may be produced, and faulty image will not formed neither at the bottom end portion of a paper sheets in the first printing nor at the top end portion of a paper sheet in the second printing. Thus, the present invention can solve the disadvantages inherent in detecting the density of toner on the development sleeve at the standby position of the revolver and makes possible stabilized toner density controlling irrespective of whether the coverage rate of the original rate is low or high by using a simple structure.

DESCRIPTION OF THE DRAWINGS

FIG. 4 is a table of experimental data showing the relationship between the toner density and faulty image.

DESCRIPTION OF THE PREFERRED EMBODIMENTS

The following will describe in detail a preferred embodiment of the present invention while having reference to the accompanying drawings, wherein like symbols designate like or corresponding parts. As will be understood from the description below, the present invention is not limited to the illustrated embodiment, but various changes therefrom are possible.

Figure 1:
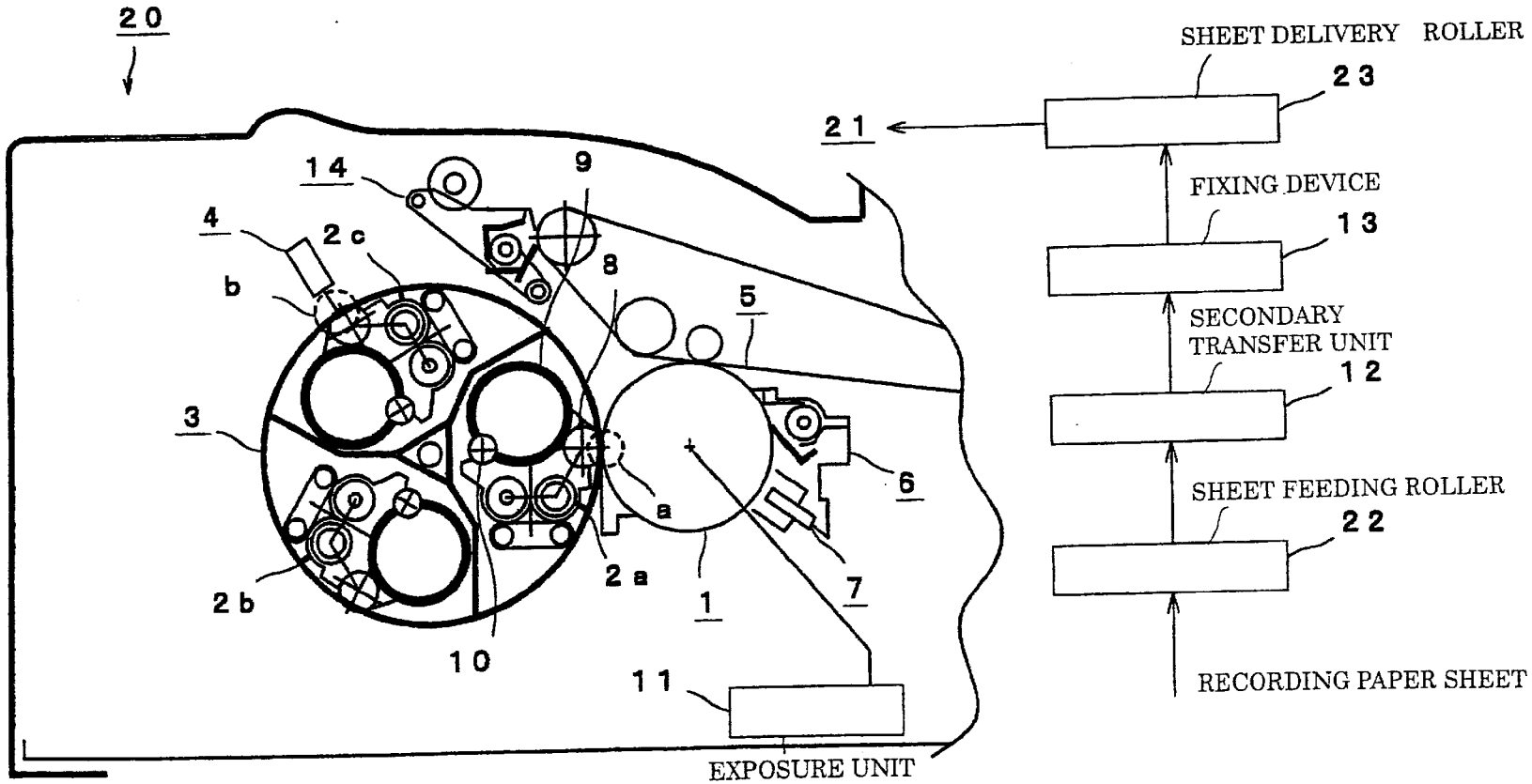
FIG. 1 is a schematic view of an image forming apparatus which is equipped with a device for practicing the toner replenishing method according to the present invention.

Referring now to FIG. 1 showing a schematic view of the embodiment of image forming apparatus according to the present invention, there are provided at the lowermost portion of an image forming apparatus proper 20 a sheet feeding cassette (not shown) storing therein image recording medium or sheets of paper arranged in a stack and at the uppermost portion thereof a sheet delivery tray 21. The sheets of paper fed out successively from the sheet feeding cassette (not shown) are conveyed upward by a sheet feeding roller 22, which is shown schematically, and further moved through a secondary transfer unit 12 and a fixing device (fixing unit) 13, which will be described in later part hereof, and delivered form the delivery tray 21 by a sheet delivery roller 23. These sheet feeding cassette, sheeting feeding roller 22, sheet delivery rollers 23 and sheet delivery tray 21 define a conveying path of the recording paper sheets.

On a lateral side of the conveying path of the recording paper sheets is disposed a photosensitive drum 1 which is rotatable in counter-clockwise direction as seen on the drawing of FIG. 1. Around the photosensitive drum 1 are disposed in opposing relation to the outer peripheral surface thereof a charging device 7 for charging the surface (outer peripheral surface) of the photosensitive drum 1, an exposure unit 11, preferably of laser beam type, for exposing the charged surface of the photosensitive drum 1 to light thereby to form an electrostatic latent image, a developing unit 3 for developing the electrostatic latent image with magnetic toner fed to the surface of the photosensitive drum 1 thereby to form a toner image, a primary transfer belt unit 5 for transferring the toner image formed on the surface of the photosensitive drum 1, and a cleaning unit 6 for removing residual toner remaining and attached on the surface of the photosensitive drum 1 after the image transferring. The aforementioned secondary transfer unit 12 is provided in opposing relation to the primary transfer belt unit 5 and transfers the toner image transferred to the belt of the primary transfer belt unit 5 to the recording paper sheet. A cleaning unit 14 is provided for removing toner remaining and attached on the surface of the belt of the primary transfer belt unit 5 after the image transferring. The toner image of the secondary transfer unit 12 is fixed on the recording paper sheet by a fixing device 13. The electrostatic latent image formed on the photosensitive drum 1 due to exposure by the exposure unit 11 is visualized into a toner image by each of the developing devices 2*a*, 2*b* and 2*c* each having incorporated therein a magnet roller 8 for feeding the developing agent. As described above, the toner image on the photosensitive drum 1 is transferred to the belt of the primary transfer belt unit 5, while the photosensitive drum 1 is cleaned by the cleaner 6 and charged again.

In the embodiment of the present invention, the revolver unit or the developing unit 3 has therein the developing devices 2*a*, 2*b* and 2*c* for developing the respective different colors, for example, yellow, magenta and cyan, and developing of each color is accomplished by rotating the revolver unit 3 in clockwise direction thereby to move the respective developing devices from the standby position to the developing or printing position. The respective toner images thus developed are superimposed on the primary transfer belt unit 5 and subsequently the images are transferred simultaneously to the recording paper sheet by the secondary transfer unit 12 and fixed by the fixing device 13, thus the desired image being produced.

The developing devices have toner cartridges 9*a*, 9*b* and 9*c*, respectively, for storing therein a toner of each color and the toner in each of the toner cartridges 9*a*, 9*b* and 9*c* can be fed into its associated developing device by rotation of an auger 10 as is well known in the art. It is so arranged that the magnet roller 8 and the auger 10 are driven to be rotated by a toner replenishing drive motor 32 (FIG. 2) only when each developing device 2*a*, 2*b* or 2*c* comes to the developing position a where it opposes the photosensitive drum 1 by rotation of the revolver unit 3. The density of toner in each of the developing devices 2*a*, 2*b* and 2*c* can be detected by a photo sensor 4 when each developing device is moved to the standby position b. As an example of the photo sensor 4 for use, it is of a reflection type according to which light is emitted from an LED to the developing sleeve and the amount of light reflected therefrom is measured by a photodiode.

Figure 2:
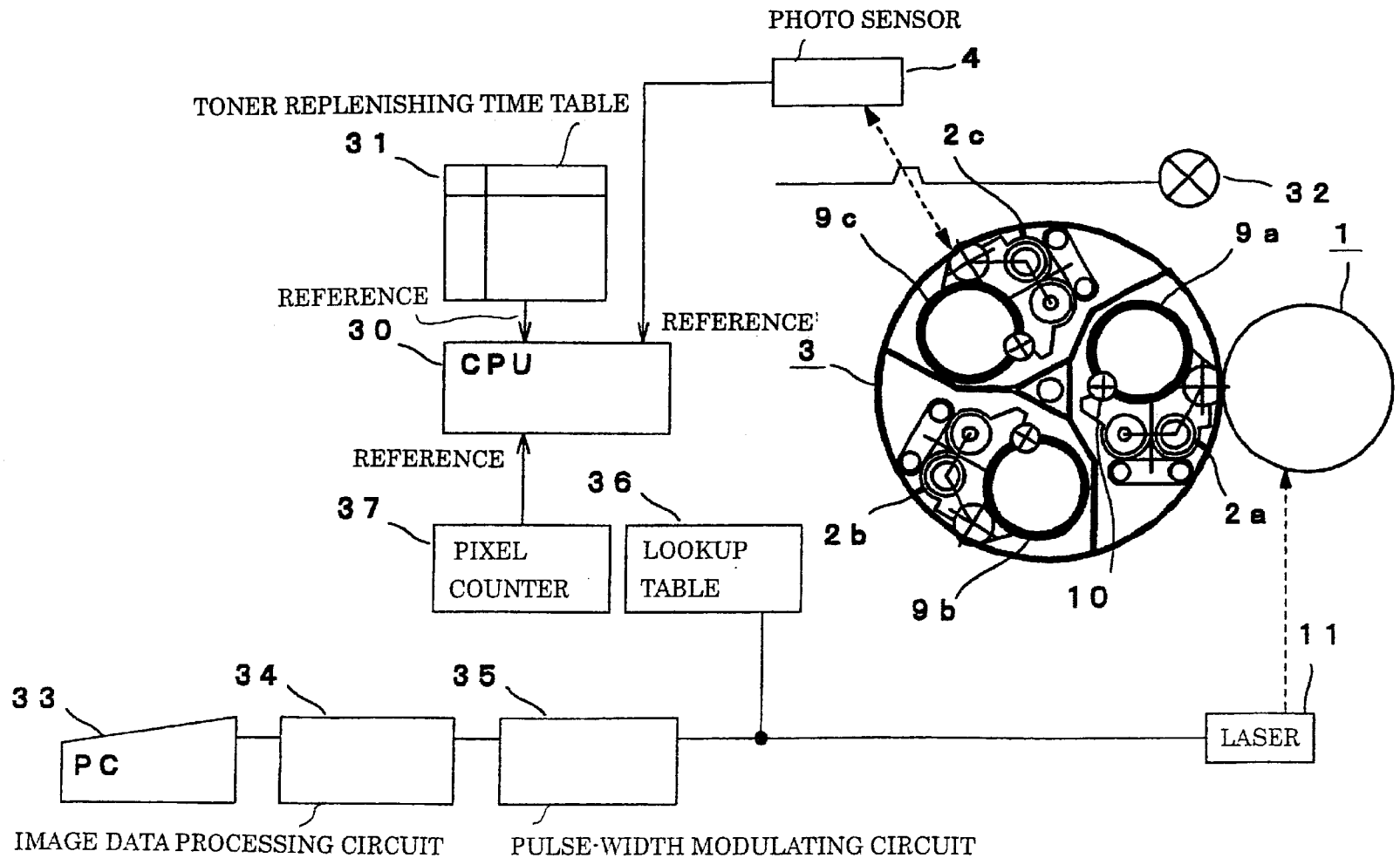
FIG. 2 is a block diagram illustrating the toner replenishing method according to the present invention.
Figure 3:
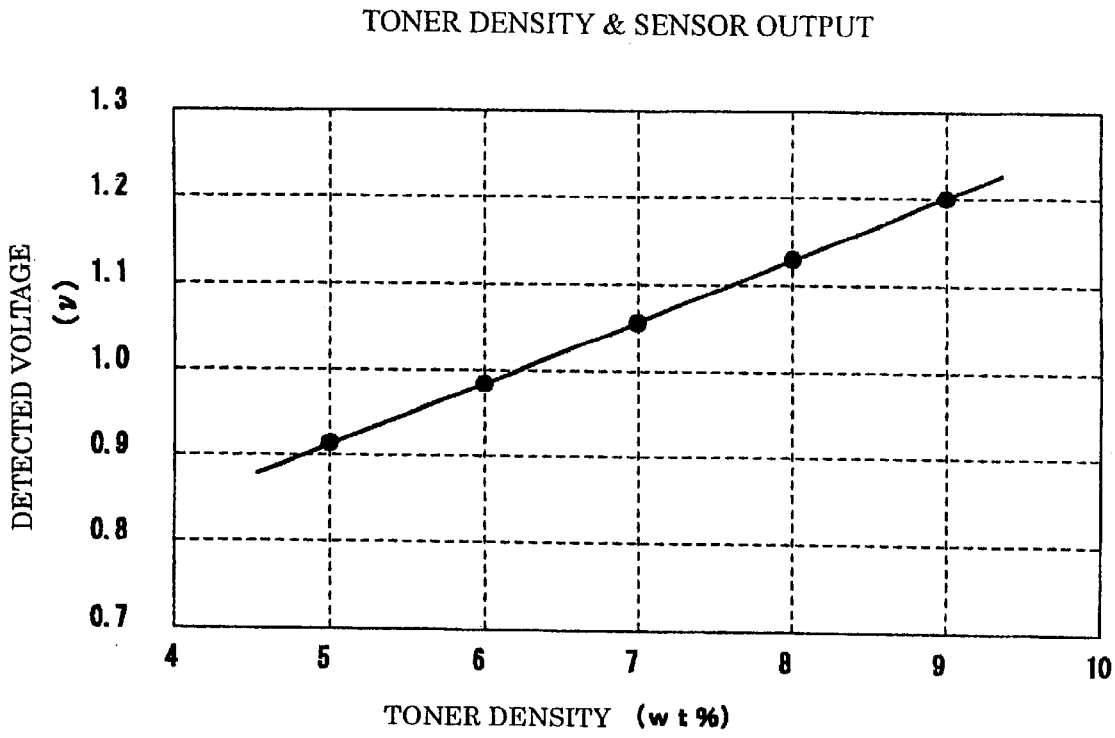
FIG. 3 is a characteristic curve showing the relationship between the output from photo sensor and the toner density.

Now referring to FIG. 2, the following will describe the preferred embodiment of toner replenishing method according to the present invention. In FIG. 2, output from the photo sensor 4 reading the density of toner in the developing agent layer on the development sleeve at the aforementioned standby position b is converted from analog to digital data by an AD converter (not shown) and then transmitted to CPU 30. It is known that the voltage representing the output from the photo sensor 4 varies substantially linearly with the toner density as shown in FIG. 3. The CPU 30 calculates a toner density from the voltage output of the photo sensor 4 and, if the calculated toner density (wt %) is found lower than a target value, the CPU 30 reads out the toner replenishing time necessary to compensate for the shortfall of toner on the basis of a toner replenishing time table 31, in which shortfall of toner with respect to a target value and toner replenishing time that is necessary to compensate for such shortfall are recorded previously, and then causes the toner replenishing auger drive motor 32 to rotate at the developing position a (FIG. 1) thereby to replenish toner.

Regarding an original (not shown), on the other hand, image data as the original transmitted, for example, from a personal computer (PC) is processed by an image data processing circuit 34, modulated by a pulse-width modulating circuit 35, light-emitting data is provided to the laser beam system or the exposure unit 11 (FIG. 1) and the photosensitive drum 1 is exposed to light for latent image formation. In the preferred embodiment of the present invention, path for the pulse-width modulated image data is branched off from the above-described path, and print pixel information is added to a pixel counter 37 through a lookup table according to the light emitting pulses of the laser beam system 11. The CPU 30 makes reference to this pixel counter 37 and has a function of generating a toner replenishing signal to the toner replenishing auger drive motor 32 if the CPU 30 determines that it is necessary to do so.

In the embodiment of the present invention, using the image forming apparatus constructed as described above, printing test was conducted under printing speed of 45 ppm, photosensitive body peripheral speed of 207 mm/sec, photosensitive body surface potential of −650 V and developing bias of −500 V. FIG.4 shows the testing results in terms of the relationship between toner density and faults in image. The toner used in the embodiment included as the main components MnMg based ferrite carrier with an average particle diameter of 40 $\mu$m and polyester resin with an average diameter of 8 $\mu$m.

Figure 5:
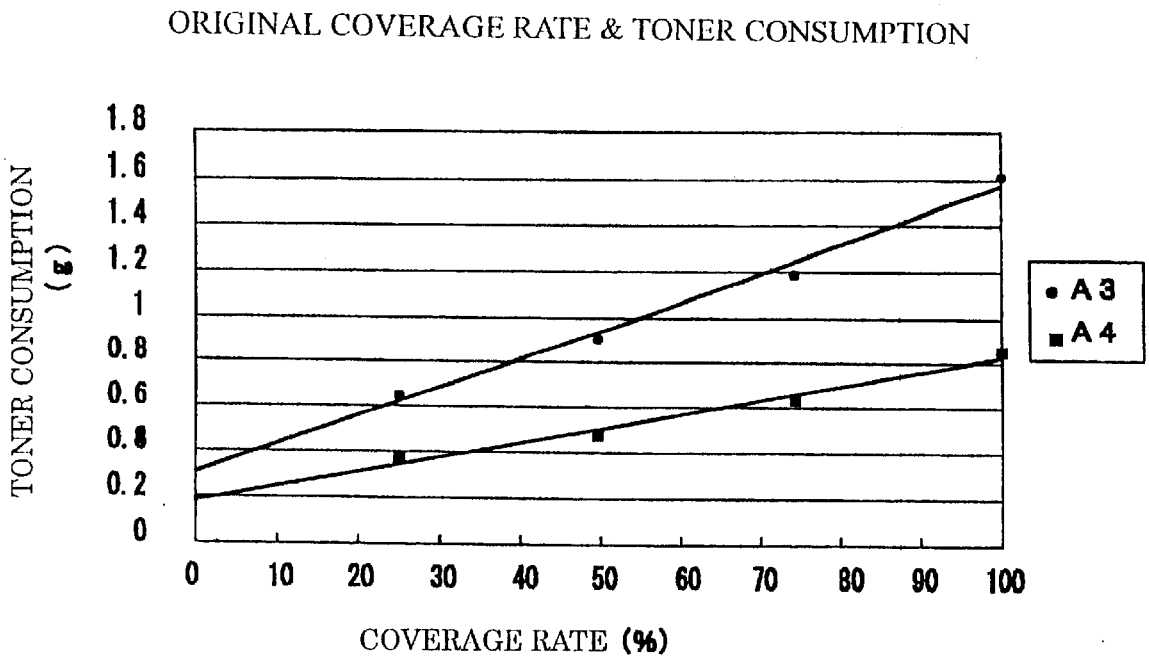
FIG. 5 is a characteristic curve showing the relationship between the coverage rate on an original and the amount of toner consumption.

As is apparent from the image characteristics shown in FIG. 4, no problem occurred with the image quality in the range of toner density from 6.5 wt % to 7.5 wt % and, therefore, toner density of 7.0 wt % was set as the initial developing agent toner density, that is the control target value. In the embodiment, 250 g of the above developing agent was put in each of the developing devices for the testing. FIG. 5 shows the relationship between the coverage rate of the original and the amount of toner consumed.

Next, the following will describe a specific toner replenishing operation when the coverage rate on the original is low and also when the coverage rate is high in the illustrated embodiment. In the embodiment, it is assumed that an original with an A3 sheet size having a coverage rate less than 80%, say averagely 50% coverage rate, is considered to have a low coverage rate.

Firstly, an electrostatic latent image is developed into a toner image by supplying toner to the surface of the photosensitive supplied drum 1 then located at the developing position a in FIG. 1 from the developing device, thus the first print being made. In the embodiment, the CPU 30 refers to value of the pixel counter 37 when image printing has proceeded for a predetermined printing width as measured from the top end of image data to be printed (for example, total pixel number of 878400 when 50 mm has been printed). If the value is less than 80% of the total pixel number, the CPU 30 predicts that the coverage rate is low and does not effect driving of the toner replenishing auger drive motor 32 according to the output of the pixel counter 37.

When the developing device comes to the standby position b of FIG. 1 after it has completed its first development, toner density of the developing agent is detected by the photo sensor 4. Since it is assumed that printing is made from an original having a 50% coverage rate, toner consumption is 0.9 g as is apparent from FIG. 5, and a toner density of about 6.6 wt % is detected. Therefore, the CPU 30 determines that replenishment of 0.9 g of toner is required and, when the developing device is moved to the developing position a again for the second printing, 0.9 g of toner is replenished. That is, for an original with a low coverage rate, toner replenishment is performed a first printout behind.

In this embodiment, though the pixel counter 37 is operated simultaneously with the start of printing by the developing device at the developing position a so as to count the number of pixels for the predetermined printing width of an original from the top end thereof, needless to say, determining the coverage rate by counting the entire image of the original by the pixel counter 30 before printing will improve the accuracy of replenishing. Though in the embodiment the predetermined valve of 80% of the total pixel number is used, it is needless to say that a plurality of values may be set in a progressive manner or continuous values may be used. Furthermore, the predetermined width of printing may be changed as required.

When the coverage rate is high, in the embodiment the first printing is performed at the developing or printing position a of FIG. 1 with the assumption that an original having an average coverage rate of 100% is used. When image data for a predetermined width from the top end of the image data for printing has been printed, the CPU 30 refers to the count value of the pixel counter 37. If the count value is greater than 80% of the total pixel number, the CPU 30 predicts that the original's coverage rate is high and causes the toner replenishment drive motor 32 to be driven according to a signal from the pixel counter 37. When the developing device comes to the standby position b of FIG. 1 after it has completed its first development, toner density is detected by the photo sensor 4. Since it is assumed that printing is made from an original having 100% coverage rate, 1.6 g of toner is consumed as seen from FIG. 5, and the toner density would become about 6.4 Wt %, that is the range of toner density where a faulty image may be formed, unless replenishment according to the reading by the pixel counter 37 is made. That is, unless toner replenishment is made, there is a fear of a high possibility that a faulty image may be produced at the bottom end portion of a paper sheet in the first development or at the top end portion of a paper sheet in the second development. According to the present invention, however, because toner replenishment begins during the first development according to the reading by the pixel counter 37, the toner density will not be reduced to such an extent that causes faulty image formation.

In the above embodiment according to the present invention, reference was made to the pixel counter 37 when printing to 50 mm position from the top end of the image was completed, so as to start toner replenishment as required, and 1.0 g of toner was replenished during the first print. The toner density detected by the photo sensor 4 at the standby station b was 6.8%, which fell outside the range of faulty image, thus no faulty image occurred during the first and second printing. It is needless to say that replenishment while making reference to the pixel counter should preferably be so adjusted that toner density would not fall in the range of faulty image due to excessive toner density even if the prediction was wrong.

While the above embodiment has been described with reference to an image forming apparatus for full-color printing using yellow, magenta and cyan developing devices, needless to say, the present invention is applicable to an apparatus having a black developing device and, in such a case, the present invention may be applied to density controlling in full-color image forming mode and black and white image forming mode in the black developing device and also to density controlling in developing devices for other than black, for example full-color image forming mode and yellow mono-color image forming mode in a yellow developing device. Furthermore, the present invention is also applicable to density controlling in other mono-color image forming modes.

What is claimed is:

1. A toner supply device in an image forming apparatus having a plurality of developing devices, wherein said plurality of developing devices are changeable between a developing position and a standby position, comprising:

a calculator for calculating an estimated toner coverage rate of a first print developed by a first developing device at the developing position;

a toner density detector for detecting, at the standby position, an actual toner density of a developing agent layer of the first print after the first developing device is changed from the developing position to the standby position; and a controller configured to:

begin replenishment of a required amount of toner to the first developing device when said first developing device is changed from the standby position to the developing position for a second print if the estimated toner coverage rate of the first print is equal to or less than a predetermined value, and begin replenishment of the required amount of toner to said first developing device before said first developing device is changed from the developing position when the first print is developed to the standby position if the estimated toner coverage rate of the first print is higher than the predetermined value.

2. A toner supply device according to claim 1, wherein calculation of the estimated toner coverage rate is performed on the basis of data of the first print during development by said first developing device.

3. A toner supply device according to claim 1, wherein said calculator calculates the estimated toner coverage rate on the basis of data of the first print from a moment of print starting from a top end of an image to be printed until a predetermined printing width of the image has been printed.

4. A toner supply device according to claim 3, wherein said predetermined printing width is changeably set.

5. A toner supply device according to claim 1, wherein said predetermined value is provided as one of progressive values and continuous values.

6. A toner supply device according to claim 1, wherein said toner density detector is comprised of a photo sensor for detecting the light reflectivity of said developing agent layer and a toner density calculator for calculating the toner density on the basis of the detected light reflectivity.

7. An image forming apparatus comprising:

a plurality of developing devices which are changeable between a developing position and a standby position;

a photosensitive body on which an electrostatic latent image is developed into a toner image by a first developing device located at the developing position;

an exposure unit for exposing said photosensitive body to light for forming said electrostatic latent image on said photosensitive body;

a calculator for calculating an estimated toner coverage rate of the electrostatic latent image formed by the first developing device at the developing position;

a toner density detector for detecting, at the standby position, an actual toner density of a developing agent layer of the latent image formed by the first developing device after the first developing device is changed from the developing position to the standby position; and a toner replenisher for replenishing toner to said developing device on the basis of said estimated toner coverage rate and said actual toner density.

8. An image forming apparatus according to claim 7, wherein said calculator calculates the estimated toner coverage rate by adding up data of the image formed by exposure to light on said photosensitive body simultaneously with the development by the first developing device.

9. A toner supply method in an image forming apparatus having a plurality of developing devices, wherein said developing devices are changeable between a developing position and a standby position to develop an electrostatic latent image on a photosensitive body, comprising:

calculating an estimated toner coverage rate of a first latent image being developed by a first developing device located at the developing position;

changing position of the first developing device from the developing position to the standby position;

calculating an actual toner density of a developing agent layer of the first latent image after the position of the first developing device has been changed to the standby position;

replenishing a required amount of toner to the first developing device when the first developing device is changed from the standby position to the developing position for a second latent image if the estimated toner coverage rate is a predetermined value or less; and replenishing the required amount of toner to said first developing device before the first developing device is changed from the developing position when the first latent image is developed to the standby position if the estimated toner coverage rate is higher than the predetermined value.

* * * * *